US009762994B2

(12) United States Patent
Mathur

(10) Patent No.: US 9,762,994 B2
(45) Date of Patent: Sep. 12, 2017

(54) ACTIVE ACOUSTIC META MATERIAL LOUDSPEAKER SYSTEM AND THE PROCESS TO MAKE THE SAME

(71) Applicant: AcoustiX VR Inc., Brooklyn, NY (US)

(72) Inventor: Gopal P. Mathur, Trabuco Canyon, CA (US)

(73) Assignee: ACOUSTIX VR INC., Brooklyn, NY (US)

( * ) Notice: Subject to any disclaimer, the term of this patent is extended or adjusted under 35 U.S.C. 154(b) by 0 days.

(21) Appl. No.: 15/367,709

(22) Filed: Dec. 2, 2016

(65) Prior Publication Data

US 2017/0085981 A1 Mar. 23, 2017

(51) Int. Cl.

| | |
|---|---|
| ***H04R 1/24*** | (2006.01) |
| ***H04R 1/26*** | (2006.01) |
| ***H04R 1/30*** | (2006.01) |
| ***H04R 23/02*** | (2006.01) |
| *H04R 1/28* | (2006.01) |

(Continued)

(52) U.S. Cl.

CPC ..... *H04R 1/30* (2013.01); *H04R 1/24* (2013.01); *H04R 1/26* (2013.01); *H04R 23/02* (2013.01); *H04R 1/2811* (2013.01); *H04R 9/06* (2013.01); *H04R 17/00* (2013.01)

(58) Field of Classification Search

CPC . H04R 1/26; H04R 1/30; H04R 1/345; H04R 1/1016; H04R 1/1083; H04R 1/2857

See application file for complete search history.

(56) References Cited

U.S. PATENT DOCUMENTS 1,771,052 A * 7/1930 Mallory ..... G10K 11/025 181/184
1,840,992 A * 1/1932 Weitling ..... H04R 1/345 181/180

(Continued)

OTHER PUBLICATIONS

Samson Beyene and Ricardo A. Burdisso, A new hybrid passive/active noise absorption system, Journal of Acoustical Society of America, Mar. 1997, pp. 1512-1515, vol. 101, No. 3, USA.

(Continued)

*Primary Examiner* — Matthew Eason

(74) *Attorney, Agent, or Firm* — Michael J. Feigin, Esq.; Feigin and Fridman

(57) ABSTRACT

An active acoustic meta material system with micro-perforated sheets embedded between porous layers and air gaps, around the output region in front of a speaker, perpendicular to the direction of wave propagation of the sound is disclosed. Sound input is split into two frequency ranges by an active controller, such that a higher frequency range is sent to a traditional speaker which outputs sound via a diaphragm which vibrates in response to electromagnetic signals generated based on the sound input. The sound waves in the lower frequency range are sent to piezoelectric or other type of motion-creating transducers which are mounted to an outer housing or casing containing a plurality of meta material sheets with insulative layers between each meta material sheet. The combination of meta material sheets and insulation layers are calibrated to focus and amplify the vibrational waves which are outputted by the transducers.

16 Claims, 7 Drawing Sheets

(51) Int. Cl.
*H04R 9/06* (2006.01)
*H04R 17/00* (2006.01)

(56) References Cited

U.S. PATENT DOCUMENTS 5,137,110 A * 8/1992 Bedard, Jr. ..... H04R 1/34 181/153
5,396,563 A * 3/1995 Yoshimi ..... H04R 1/1016 381/328
5,692,059 A * 11/1997 Kruger ..... H04R 1/1016 381/151
5,812,686 A 9/1998 Hobelsberger
5,933,508 A * 8/1999 Fuke ..... H04R 1/30 381/343
5,945,642 A * 8/1999 Nayar ..... B06B 3/00 156/580.2
6,411,718 B1 * 6/2002 Danley ..... H04R 1/26 181/144
8,284,976 B2 * 10/2012 Danley ..... H04R 1/24 381/182
9,231,309 B2 1/2016 Dede et al.
9,392,358 B2 * 7/2016 DeLay ..... G10K 11/22
9,503,807 B2 * 11/2016 Murphy ..... H04R 1/26
2002/0106097 A1 * 8/2002 Danley ..... H04R 1/26 381/345
2010/0271692 A1 10/2010 Hor et al.
2012/0033822 A1 * 2/2012 Kakumoto ..... H04R 1/1016 381/71.6
2012/0313854 A1 12/2012 Senanayake et al.
2014/0341419 A1 11/2014 Risberg et al.
2015/0129351 A1 5/2015 Wheeler
2015/0358712 A1 * 12/2015 Ji ..... H04R 1/1008 181/129
2016/0192062 A1 * 6/2016 DeLay ..... H04R 1/20 181/184

OTHER PUBLICATIONS

Baolandet, Roman; Lissck, Herve; Rivet, Etienne, Advanced control for modifying the acoustic impedance at the diaphragm of a loudspeaker, Proceedings of the 11th French Congress of Acoustics and 2012 Annual IOA Meeting, 2012, 1-5.
Cobo, Pfretzchner. Cuesta and Fernandez, Low frequency absorption by active control of impedance, paper ID 23, Acustica Guimaraes, 2004, pp. 1-8, Portugal.
Image of moving coil loudspeaker, https://en.wikibooks.org/wiki/Engineering_Acoustics/Transducers_-_Loudspeaker, accessed Dec. 9, 2016.

* cited by examiner

ACTIVE ACOUSTIC META MATERIAL LOUDSPEAKER SYSTEM AND THE PROCESS TO MAKE THE SAME

FIELD OF THE DISCLOSED TECHNOLOGY

The present disclosure relates generally to loudspeakers, and more specifically, to increasing sound fidelity in the far field.

BACKGROUND OF THE DISCLOSED TECHNOLOGY

Loudspeakers or speakers covert an electrical impulse into a mechanical impulse which produces sound, usually by way of the use of electromagnetism which moves a cone. For purposes of this disclosure, a "loudspeaker" is defined as an electro-acoustic transducer which converts an electrical signal into audio output. Such devices are integral parts of every common audio system. This process involves many difficulties and has proven to be the most problematic of the steps to reproduce sound. As a result, loudspeakers are almost always the limiting element in the fidelity of the acoustics of the reproduced sound in home, theater, or in many entertain systems. The other elements in sound reproduction are mostly electronic which are highly advanced and developed.

Ideally, a loudspeaker should create a sound field proportional to the electric signal of the amplifier. Due to the physics of sound radiation, the output is almost always less than ideal particularly in the low frequency region. In general, the common loudspeaker may be split into two parts: an electromechanical and a mechanical-acoustical part. The latter has a diaphragm, the vibration of which creates sound pressure. One of the greatest difficulties in the conversion of electrical into acoustical energy has been the realization of a prescribed (mostly flat) frequency response in a certain (mostly large, broadband) frequency range. The broadband frequency range, for purposes of this disclosure, is between 20 and 20,000 Hz (Hertz).

An unenclosed loudspeaker radiates sound as an acoustic "dipole". This gives rise to a poor low frequency or bass response since sound from the back of the diaphragm cancels sound from the front. For purposes of this disclosure, low frequency or bass response refers to sound less than 200 Hz, 100 Hz, or 80 Hz. The sound also radiates highly directionally. To avoid these problems, the loudspeaker can be mounted in an infinite baffle, in which case it radiates into the "half space" in front of the baffle as a monopole. Even with infinite baffles, loudspeaker radiation efficiency lessens considerably at low frequencies with a simple baffle board. To deal with this impracticality, the infinite baffle is "folded" around the back of the loudspeaker, forming an 'infinite baffle' enclosure (a closed box). However, this does not solve the problem of poor bass response.

Even with a good enclosure a single loudspeaker can not be expected to deliver optimally balanced sound over the entire audible frequency range. The requirements of producing adequate acoustic output at both low and high frequencies are mutually incompatible. In the high frequency range, the driver needs to be light and small to be able to respond rapidly to applied signal. Such high frequency speakers are known as tweeters. On the other hand, a bass speaker should be large to efficiently match the impedance to air. Such speakers, called, woofers, must also be driven with more power to drive a larger mass. Additionally, due to human ear's low response to bass, more acoustic power must be supplied in the bass or low frequency range. Sometimes, a third, mid-range speaker is also used to achieve a smooth frequency response.

Referring now more specifically to the low frequency response, a subwoofer is a woofer driver used only for the lowest part of the audio frequency range such as below 200 Hz (e.g., consumer systems), below 100 Hz (e.g., professional live sound), or below 80 Hz (as in "THX" approved systems known in the art). Because the intended range of frequencies is limited, subwoofer system design usually has a single driver enclosed in a suitable enclosure. Sound in this frequency range can easily bend around corners by diffraction (as low frequencies are "non-directional"), so the speaker aperture does not have to face the audience, and subwoofers can be mounted in the bottom of the enclosure facing the floor for convenience. To accurately reproduce very low bass notes without unwanted resonances (typically from cabinet panels), subwoofer systems must be solidly constructed and properly braced; good speakers are typically quite heavy. Many subwoofer systems include power amplifiers and electronic sub-filters, with additional controls relevant to low-frequency reproduction. These alternatives are known as "active" or "powered" subwoofers. Active subwoofers, like active monitors, have built-in power amplification to boost low frequency sound. In contrast, "passive" subwoofers require external amplification.

The loudspeaker, which generates acoustic pressure, has an internal source impedance and drives an external load impedance. The ambient air medium is the ultimate coupling load, which presents a low impedance because of its low density. The source impedance of any loudspeaker, on the other hand, is high (compared to the impedance of ambient air), so there will be a considerable mismatch between the source and the load. The result is that most of the energy put into a direct radiating loudspeaker will not be released into the air, but will be converted to heat in the voice coil and mechanical resistances in the unit. The problem is worse at low frequencies where the size of the source is small compared to a wavelength. The source pushes the medium away. At higher frequencies, the radiation from the source is in the form of plane waves that do not spread out. The load, as seen from the driver, is at its highest, and the system is as efficient as it can be.

When the loudspeaker diaphragm vibrates, pressure waves are created in front, which creates the sound we hear. Coupling the motion of the diaphragm to the air properly is difficult due to the very different densities of the vibrating diaphragm and air. This can be viewed as an impedance mismatch. It is known that sound travels better in high density materials than in low density materials, and in a speaker system, the diaphragm is the high density (high impedance) medium and air is the low density (low impedance) medium. The horn assists the solid-air impedance transformation by acting as an intermediate transition medium. In other words, it creates a higher acoustic impedance for the transducer to work into, thus allowing more power to be transferred to the air.

Consumer electronic devices, such as cell phones, tablets, and the like with more features and capabilities are ubiquitous and are positioning to become entertainment centers. However, they also exhibit severe audio deficiencies as mentioned above and pose many additional challenges to maintain the acoustic performance as enclosed acoustic volume size, power and membrane size are reduced significantly. Due to the smaller size of the speaker used in such devices, the low frequency response is severely affected. For example, as the size of the cell phone decreases, the volume of air behind the diaphragm is reduced. This small amount of volume behind the speaker limits the range of motion of the diaphragm. The speaker does not produce enough force to compress the air beyond a certain point, hence causing the air to push back. This reduces the displacement of the speaker diaphragm, which in turn lowers the output. Thus, low frequencies are affected the most by this phenomenon as the diaphragm moves with the largest amount of displacement at these frequencies. Consequently, the frequency response usually rolls off faster at low frequencies (<300 Hz).

A wave can be described as a disturbance that travels through a medium, transporting energy from one location to another location. The medium is simply the material through which the disturbance is moving. In solids, sound waves travel in the form of the vibration or wave of molecules produced when an object moves or vibrates through a medium from one location to another. When an object moves or vibrates, the molecules around the object also vibrate, producing sound. Sound can travel through any medium except vacuum.

Sound fields radiated from loudspeakers can be divided into distinguishable regions. Two of which are the geometrical near field and the far field. Close to the source (the near field), for some fixed angle θ, the sound pressure falls off rapidly, $p \propto 1/r^2$. Thus in the near field, the sound pressure level decrease by 12 dB for each doubling of distance r. In the far field, the sound pressure levels decrease monotonically at a rate of 6 dB for each doubling of the distance from the source and are characterized by the criteria given below:

$$r \gg \lambda/(2\pi),\ r \gg a,\ r \gg \pi a^2/(2\lambda),$$

where the inequality represents a factor of 3 or greater, r is distance to the source, a is the characteristic source dimension and λ is the wavelength of radiated sound. Thus, it is advantageous to design loudspeakers according to a far field criterion.

The most commonly used far field reference distance for loudspeaker SPL specifications is 1 meter (or 3.28 feet). Sound field of loudspeakers must be measured at a distance beyond which the shape of the radiation pattern remains unchanged as the changes are caused by path length differences to different points on the surface of the device. For relatively smaller loudspeakers sound field might possibly be measured at 1 meter, but for larger loudspeakers it needs a different far field measurement scheme. For large devices, the beginning of the far-field must be determined, marking the minimum distance at which radiation parameters can be measured. The resultant data can then be referenced back to the 1 meter reference distance using the inverse-square law. This calculated 1 meter response can then be extrapolated to further distances with acceptable error.

Sound-absorbing materials such as foams, fiberglass, absorbent panels, etc. are commonly used in various industries and buildings to reduce noise for which the sound waves are reflected, absorbed and transmitted when they hit a hard surface. A commonly used term to define and evaluate sound absorption is the sound absorption coefficient. The sound absorption coefficient is a measure of the proportion of the sound striking a surface, which is absorbed by that surface, and is usually given for a particular frequency. Thus, a surface which would absorb 100% of the incident sound would have a sound absorption coefficient of 1.00, while a surface which absorbs 35% of the sound, and reflects 65% of it, would have a sound absorption coefficient of 0.35. Materials which are dense and have smooth surfaces, such as glass, have small absorption coefficient, whereas porous-type materials, such as glass wool or fiberglass blankets, that contain networks of interconnected cavities tend to scatter the sound energy and tend to trap it. Therefore, there is greater interaction at the surface of such materials and more opportunities during these scattering reflections for the sound wave to lose energy to the material. Consequently, these materials possess relatively larger sound absorption coefficients in the mid to high frequency range, i.e. above 500 Hz.

A way of increasing the fidelity of acoustic reproduction of sound has long been desired. While sound quality does continue to improve, the efforts in increasing fidelity in far-field applications especially has largely stalled.

SUMMARY OF THE DISCLOSED TECHNOLOGY

Embodiments of the disclosed technology relate generally to improving acoustic characteristics and radiation efficiency of speakers over a broadband frequency range.

An embodiment of the disclosed technology includes a speaker with diaphragm directing sound transverse to a plane of the diaphragm. The plane can be the front of the speaker from which sound is directed outward. A torus of material surrounds the transverse direction of the sound, meaning that the sound passes through a portal through the torus. The torus is defined as a shape which has a circular portal surrounded by a ring, or which can be described as a surface of revolution generated by revolving a circle in three-dimensional space about an axis coplanar with the circle. The torus of material has at least one layer of a micro-perforated sheet and at least one layer of insulation. A plurality of spaced apart transducers on an external side of the torus (a side opposite the portal) output pressure waves through the at least one micro-perforated sheet, and in embodiments, towards the center (portal) of the torus.

Higher frequency sound is outputted through the speaker diaphragm and lower frequency sound, compared to said higher frequency sound, is directed to the transducers in embodiments of the disclosed technology. The threshold for frequencies sent to the diaphragm (higher frequencies) versus the transducers outputting into the torus (lower frequencies) can be 120, 200, or 300 Hertz. There can be an overlap of 10, 20, 50, or 100 Hertz of sound which sent to both the speaker diaphragm and transducers. The transducers are, in embodiments, piezo-electric or other type of motion inducing transducers bonded to a metallic or non-metallic structural ring which convert electrical impulses into pressure waves.

The lower frequency sound, in embodiments, is pushed transverse to the plane of the diaphragm (away from the speaker) with respect to the higher frequency sound. Thus, the lower and higher frequency sounds can join to create waves with higher amplification at, at least some frequencies compared to if the waves had not joined and/or the lower frequency sounds were not created away from the diaphragm by the higher frequency sounds.

At least one layer of the micro-perforated sheet and layer of insulation, designed using acoustic meta materials (herein, "AMM"), have their impedances matched such that, in embodiments of the disclosed technology, pressure waves created by the transducers are amplified and focused while passing through the at least one sheet and insulation. The transducers can be fixed to a structural sheet surrounding the torus and can be arranged equi-spaced there-around. A second set of transducers are arranged, in some embodiments, also equi-spaced around the torus, but at a different distance from the diaphragm than each of the plurality of transducers arranged equi-spaced around the torus.

Another way to describe embodiments of the disclosed technology are with a frequency divider, a device which receives input of data representing or being sound waves and splits the data and/or sound waves into higher and lower frequency sounds, compared to each other. The higher frequencies are send to a speaker with diaphragm and comparatively lower frequencies are sent to transducers which generate pressure waves. Alternating micro-perforated sheets with alternate insulation material sheets are situated in front of the transducers. The micro-perforated sheets and insulation in combination have an impedance matched with the pressure waves generated by the transducers causing amplification of the pressure waves which also output sound, over part or all of the range, in the aforementioned lower frequencies.

The alternating micro-perforated sheets and insulation material can be arranged in parallel layers, one on top of the other, laid out or rolled into a circle creating a torus shape and are unique and designed using acoustic meta material approach. The transducers are then placed on an exterior structural sheet on the outer side of the layered micro-perforated sheets/insulation material. When these layers are wrapped into a circle creating a torus shape, the transducers can have a business or working end which outputs the pressure waves facing towards the center of the torus, such that the pressure waves are propagated through the torus of material towards its center. At the center, in embodiments, there is a portal which opens on either side of the torus with one side being at (touching or within 5 mm or 1 cm) of the diaphragm of the speaker. A majority of amplitude of the higher frequencies generated by the diaphragm of the speaker passes through this portal in embodiments of the disclosed technology.

Pressure waves and waves emanating from the diaphragm of the speaker merge, in embodiments of the disclosed technology, such that waves emanating from the diaphragm cause the pressure waves generated by the transducers to move in a direction away from the diaphragm.

Described yet another way, a speaker is oriented such that sound is directed substantially in a first cardinal direction. Cardinal directions refer to directions which are 90 degrees offset from one another, not necessarily pointing in compass directions. Acoustic meta material micro-perforated sheets are oriented with individual sheets transverse to the first cardinal direction (e.g. in a second cardinal direction). A portal surrounded by the micro-perforated sheets is open to the speaker such that a majority of the sound from the speaker passes through the portal when the speaker emits sound.

The portal can have a diameter substantially equal to a widest diameter of the speaker. This portal can further be centered over a most elongated length of the speaker. Perforations in each of the individual sheets occur at intervals substantially equal to a thickness of each individual sheet in some embodiments.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

Sound input is split into two frequency ranges by a controller, such that a higher frequency range, such as above 120, or 200 Hz, is sent to a traditional speaker which outputs sound via a diaphragm which vibrates in response to electromagnetic signals generated based on the sound input. The sounds in a lower frequency range are sent to a plurality of piezoelectric transducers which are mounted to a flexible structural casing or ring, and act upon, a plurality of meta material sheets with insulative layers between each meta material sheet. The combination of meta material sheets and insulation layers (have matched impedance or substantially matched impedance) are designed and calibrated to amplify and focus lower frequency sound waves with sound waves which are outputted by the transducers. The plurality of meta material sheets can be arranged in a circle, forming a torus shape which surround a portal, the portal in front of the diaphragm of the speaker such that sound outputted from the speaker substantially passes through the portal of the torus. The overall meta material sheet and insulative layer system may also be arranged in other shapes, such as rectangular, etc., depending on design and optimization requirements.

Embodiments of the disclosed technology will become clearer in view of the following description of the figures.

Figure 1:
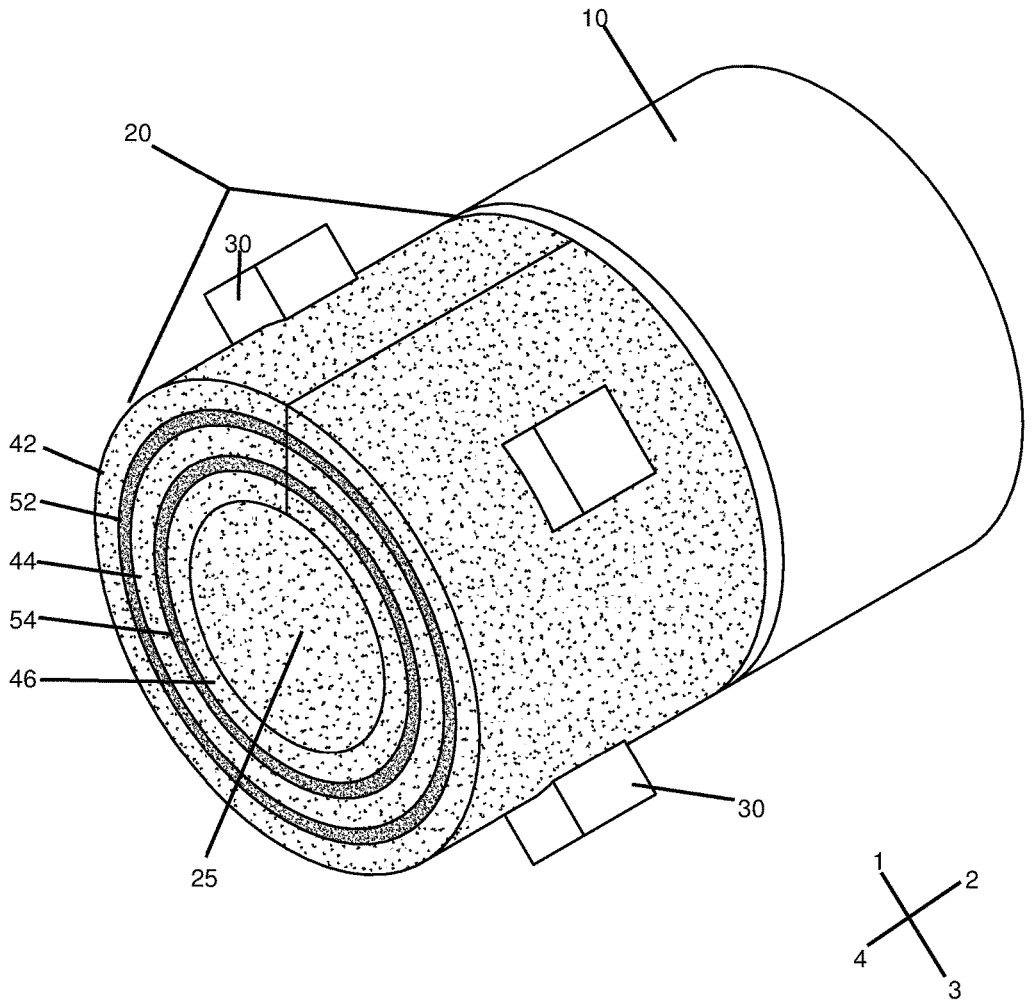
FIG. 1 shows a perspective view of a speaker with acoustic meta material torus of embodiments of the disclosed technology.

FIG. 1 shows a perspective view of a speaker with acoustic meta material torus of embodiments of the disclosed technology. A speaker, such as speaker 10, is a device which produces sound through vibration of a diaphragm that is connected to a fixed position chassis. Fixed, in this context, refers to its stationary position relative to the movement of the diaphragm. A dust cover extends over part or all of an outer surface of many speakers. A magnet or magnets receives an electrical current which causes an electromagnetic field to act on coils situated about a center pole such that a spider and a surround pull on the diaphragm causing it to move and emit sound. The direction of sound emission is away from the center pole in the direction transverse to outer edge of the speaker, usually in a direction away from a generally longitudinal axis of the dust cover. Such a speaker and diaphragm is used in embodiments of the disclosed technology for higher frequencies, whereby the "higher frequencies" are compared to frequencies which are lower and which are sent to transducers (e.g., piezoelectric, or others types) 30.

Here, the speaker has layers of meta material 42, 44, and 46 with air space and/or insulation layers 52 and 54 situated between each layer of meta material. The sound waves are emitted from the speaker 10 in the direction 4 away from the top of the speaker. That is, the direction 4 of the sound waves are defined as the primary direction (direction with a majority of sound waves) of sound exiting from a speaker, such as speaker 10. The directions are shown in the cross-legend below the figure where 4 is towards the front of the speaker 10 and in a direction where a majority of the sound waves are emitted. Direction 2 is in the opposite cardinal direction, where as a plane defined by direction line 1-3 is parallel to a front side of the speaker 10 where the sound is emitted from.

The speaker is typically placed in an enclosure, a flexible or rigid housing, made of plastic or other suitable material, (in which case layer 42 should be seen as such a housing) which holds there-within layers of micro-perforated sheets an the portal 25. Any number of alternating micro-perforated sheets and insulation can be used. There-within the sheets is a portal 25 which is surrounded or has it's extent defined by, in embodiments of the disclosed technology, an innermost micro-perforated (MPP) layer 46, arranged within porous layers. Each MPP layer, is separated by air gaps and porous layers. That is, each layer may have air gaps between 0.01 mm and 0.2 mm, and between each layer there may be a space between 0.1 mm and 20 mm. The non-resonant nature of the impedance matching effectively decouples the front and back surfaces of the meta material perforated plate(s) allowing independently tailoring of the acoustic impedance at each interface. By tapering the cross section area of the waveguides with depth into the meta material it is possible to change the open area of the perforated plate for the incident and exit surfaces independently, thereby achieving impedance matching to two acoustic media with different values of impedance. The impedance matching is essentially frequency independent and may be tailored by the geometry of the acoustic meta material impedance matching device. This type of periodic pattern optimizes and manipulates the effective constitutive properties (density and sound velocity) of an acoustic meta material mostly composed of impenetrable hard materials, in order to realize broadband impedance matching. The diameter, number and depth of perforations across the width may also be varied.

Figure 2:
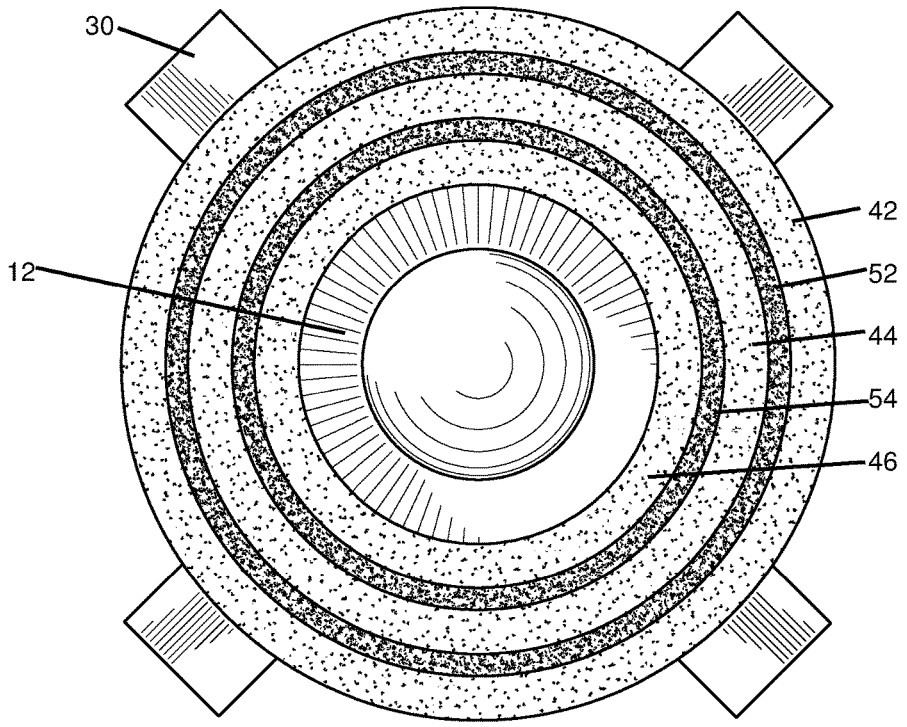
FIG. 2 shows a front view of the speaker with torus of FIG. 1.

FIG. 2 shows a front view of the speaker with torus of FIG. 1. Here, the speaker 10 is oriented such that sound is directed away from the speaker and it's front side of the diaphragm 12 in a direction 4, into an open space 25. The MPP sheets or layers 46, 44, and 42 (by way of example, but not limitation) are positioned periodically within porous layers of insulative material 52 and 54 and air gaps on the side of the speaker diaphragm. The acoustic meta material device can be designed and added to the back side of the diaphragm to reduce back radiation and increase sound radiation to the front of the speaker. These back meta material sheets may also include sound absorbing layers to further curtail back radiation. The front acoustic meta material sheets may be designed to further optimize impedance matching and to increase sound radiation to the front of the diaphragm. Both back and front meta material sheets may be multiple in numbers depending on the design and optimization. The angle, spacing, and other parameters of meta material sheets and interspersed layers determine the pattern, direction (vector), and strength of sound radiation both in the back and front of the diaphragm of the loudspeaker.

Figure 3:
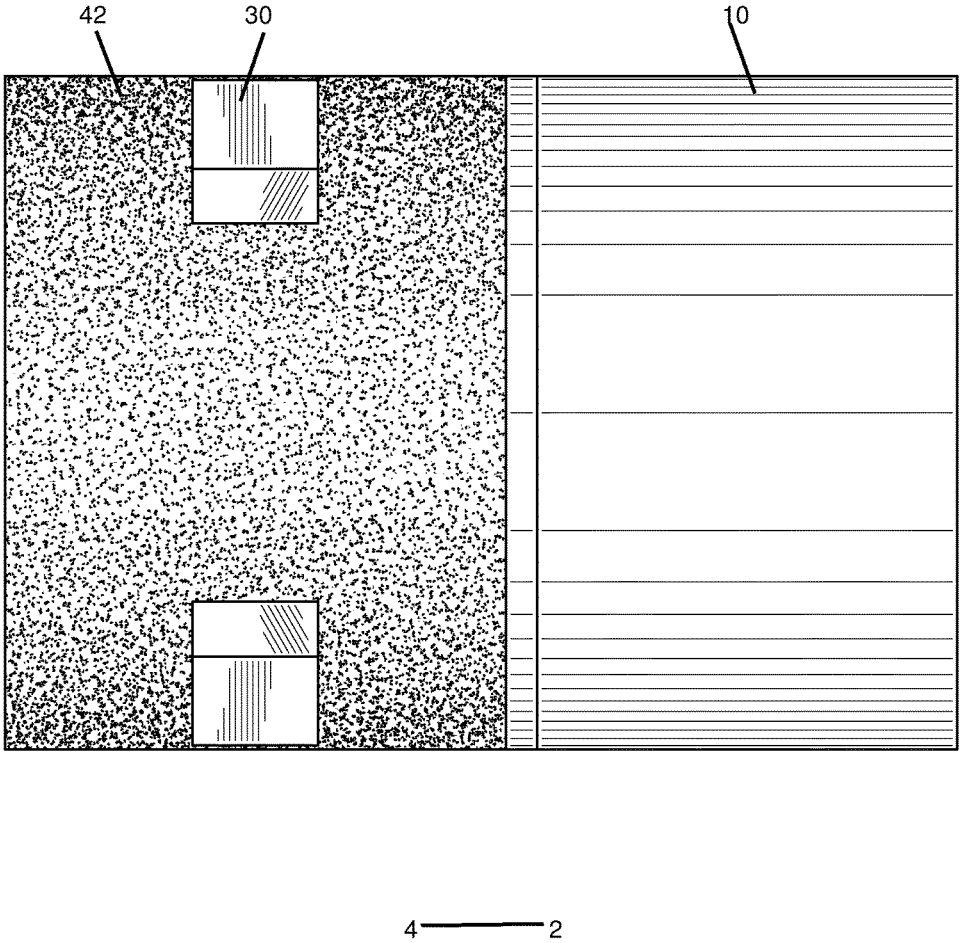
FIG. 3 shows a side elevation view of the speaker with torus of FIG. 1.
Figure 4:
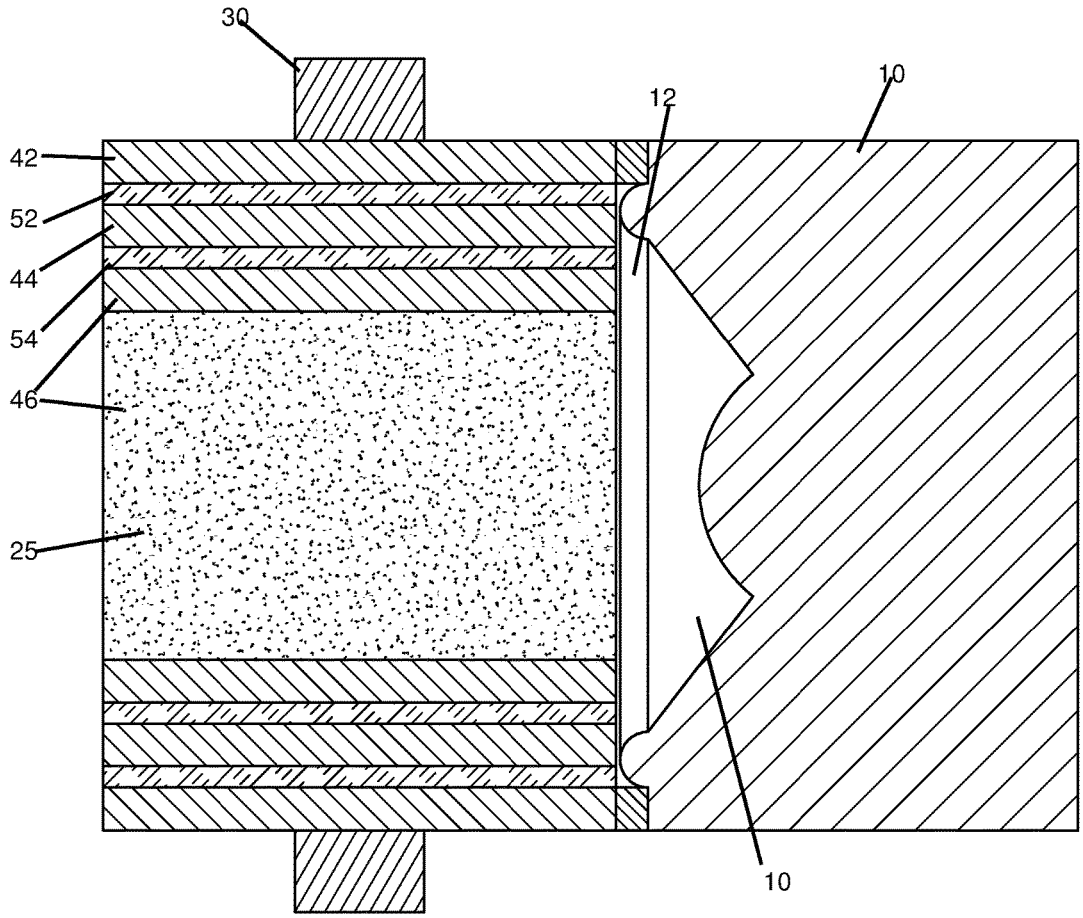
FIG. 4 shows a cutaway side elevation view of the speaker with torus of FIG. 2.

FIG. 3 shows a side elevation view of the speaker with torus of FIG. 1. FIG. 4 shows a cutaway side elevation view of the speaker with torus of FIG. 2. Here, the side of the speaker 10 with a diaphragm 12 abutting or next to meta material layers 42, 44, and/or 46 are shown. The diaphragm 12 points (has it's concave side) in the direction of the portal 25. Region 25 may represent the ambient medium, i.e., air. The MPP layers can be within a housing or meta material layer 42 in front of the business end the speaker. Transducers 30, which are mounted on a structural ring convert electrical energy into pressure waves, receive low frequency signals or electrical impulses and output pressure waves. The transducers are spaced around the outer region of the housing consisting of or comprising meta material layers and direct the pressure waves towards the middle (portal 25) of the layers in embodiments of the disclosed technology, or at least, through multiple layers of MPP and insulative porous layers where the impedance is matched to the frequency of the pressure waves in order to amplify the amplitude of the low frequency sounds.

Figure 5:
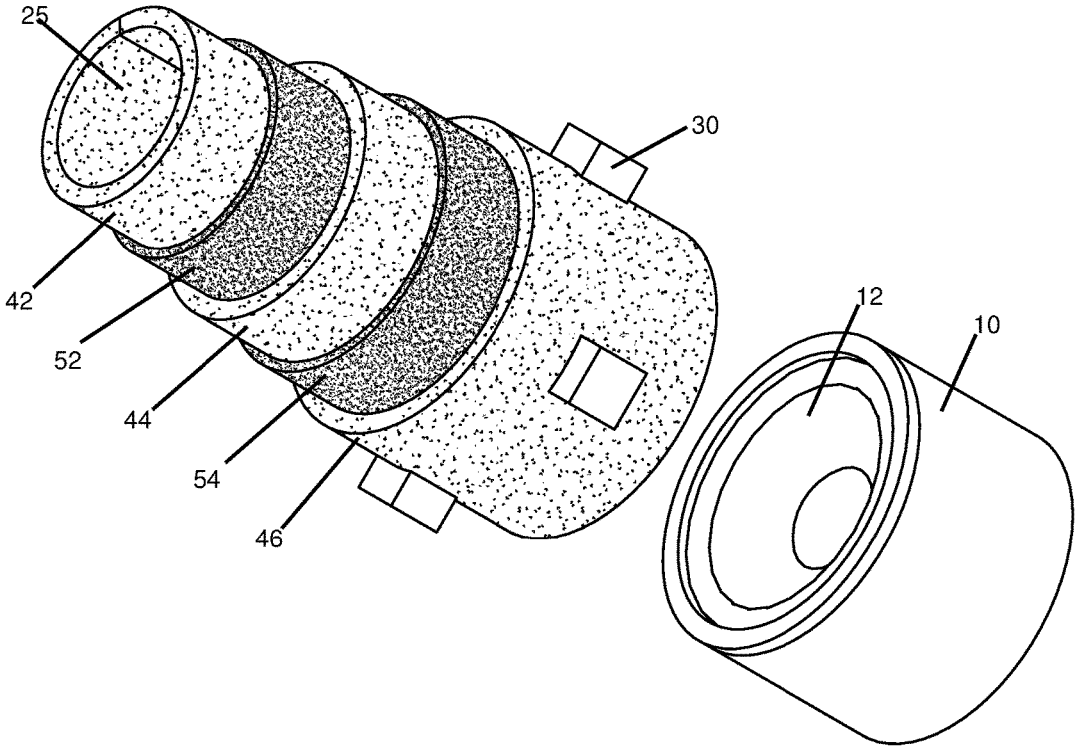
FIG. 5 shows a partially exploded perspective view of the speaker with torus of FIG. 1.

FIG. 5 shows a partially exploded perspective view of the speaker with torus of FIG. 1. Note that the portal 25 in embodiments of the disclosed technology is the width, or substantially the width, of the widest part of the speaker 10 or diaphragm 12. The MPP layers 42, 44, and 46 with air gaps and porous layers 52, and 54 are situated around the portal 25. This further forms a torus shape (circular path) around the transverse path of the sound waves from the speaker diaphragm 12, compared to the path of the torus. The sound extends in a forward direction, defined as away from the plane of the speaker diaphragm 12, as well as in some embodiments, transverse to the speaker in direction, in some cases, partially into the MPP layers and porous layers.

Figure 6:
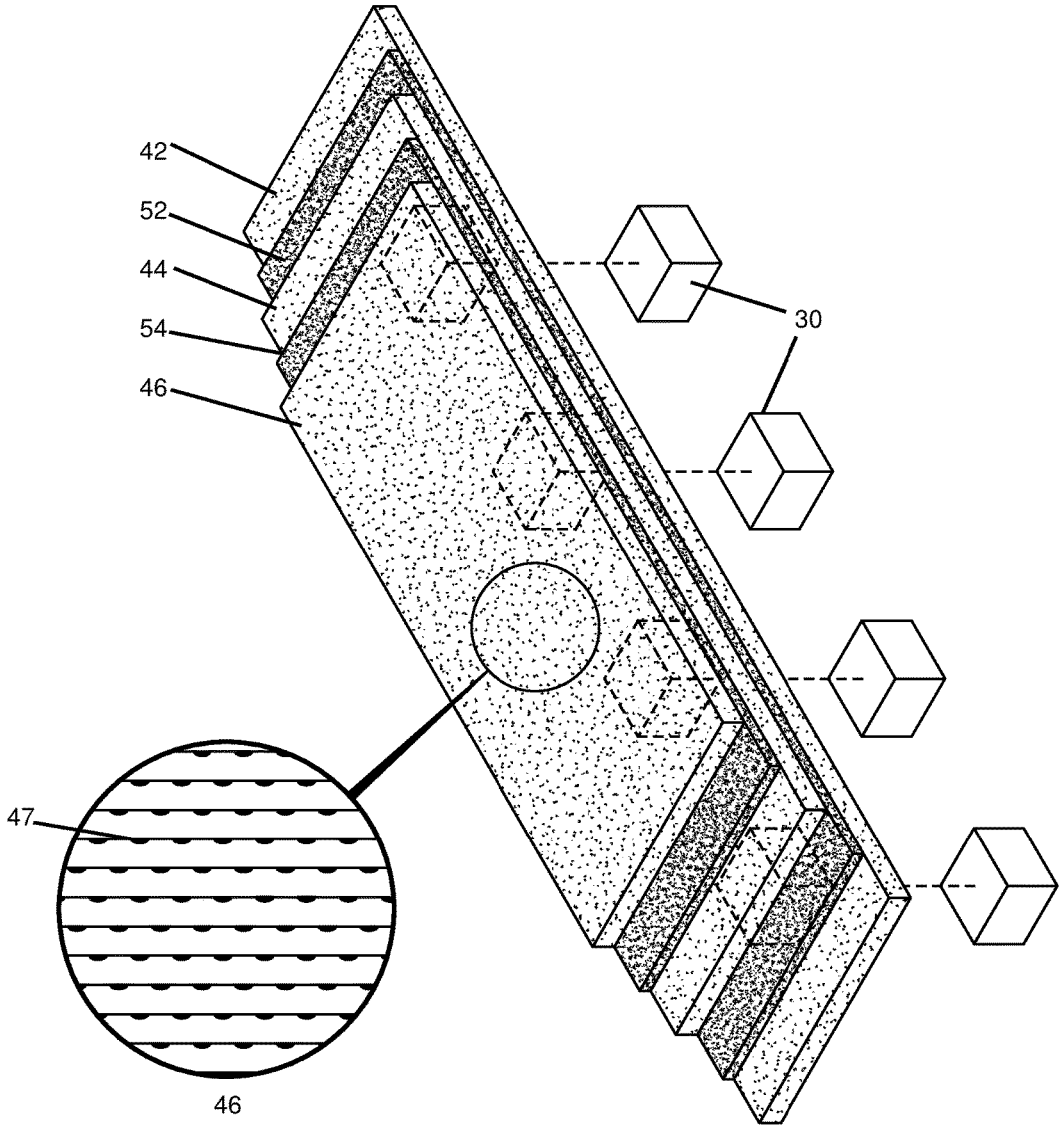
FIG. 6 shows a perspective view of meta material layers laid flat with transducers, as used in embodiments of the disclosed technology.

FIG. 6 shows a perspective view of meta material layers laid flat with transducers, as used in embodiments of the disclosed technology. In some embodiments, the transducers all have a business end which directs pressure waves towards a central point, e.g. a central point of a torus and/or of the portal 25. In other embodiments, the transducers mounted on a structural ring direct pressure waves each in the same direction. Combinations of these embodiments with some transducers directing in the same direction, and some directing in parallel to others are also possible. An inset of the inner MPP layer 46 is shown with spaced apart holes 47 adding porosity there-to and allowing sound waves to pass through with impedance matching, as described above.

Figure 7:
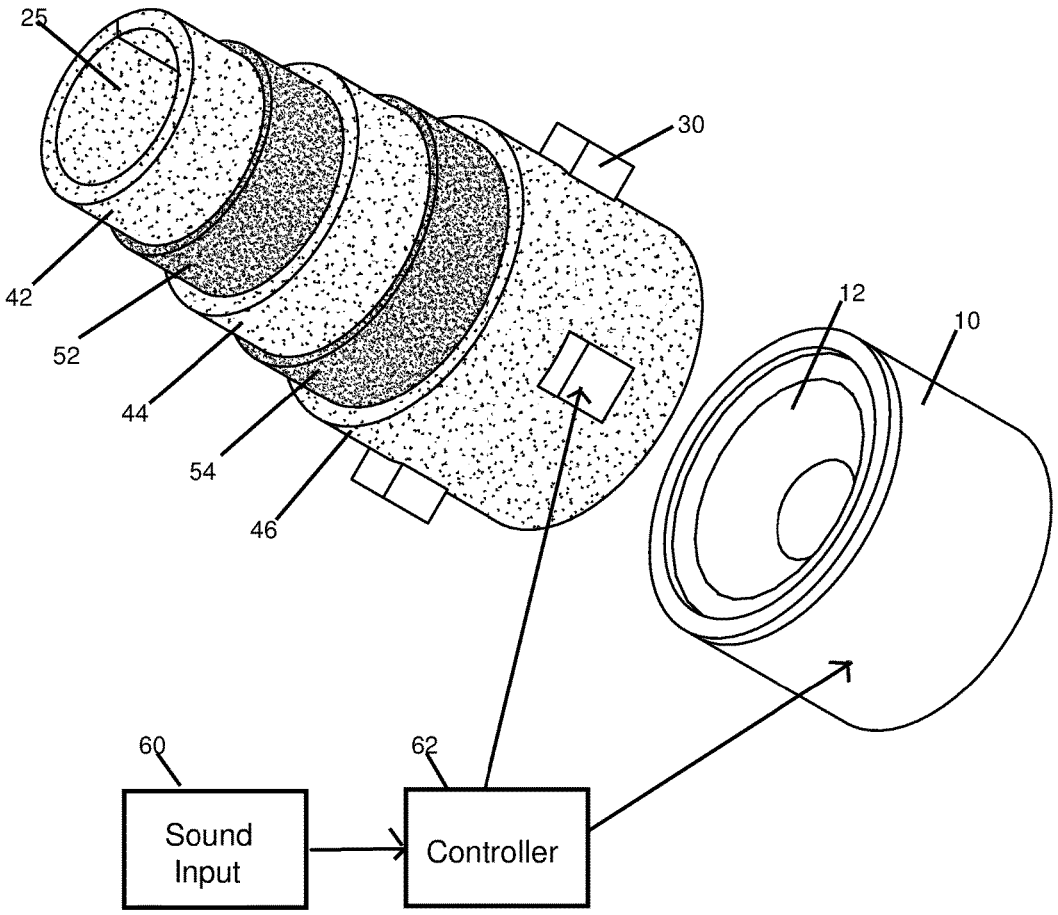
FIG. 7 shows the partially exploded perspective view of FIG. 5 with devices used to interact with the speaker and meta material layers.

FIG. 7 shows the partially exploded perspective view of FIG. 5 with devices used to interact with the speaker and meta material layers. A sound output device 60 is used which outputs sound in the form of electromagnetic current or other methods known in the art. The sound outputted may be from a port in a stereo system, hand-held device, or any other sound outputting device known in the art. The sound is sent to a controller 62, which may be housed together with the speaker 10 and transducers 30. An active control circuit, a type of controller, is used in embodiments of the disclosed technology to separate high frequency and low frequency signals, as described above. Higher frequency signals are sent to the speaker 10 (such as a tweeter or mid-range speaker used in the prior art, or any other standard speaker) while lower frequency signals are set to the transducers 30. Said another way, an electric input 60 which carries an audio signal is sent to the speaker 10 as well as the controller 62. The controller, in some embodiments, is a LMS (Least Mean Square) controller.

In order to optimize far-field (>1 meter) acoustics, which are critical for sound waves to radiate to so that they do not dissipate with distance and reach listeners, one can first simulated and optimize the output to the transducers 30 through repeated iterative tests, changing the frequency range which is sent to the transducers, output amplitude of the transducers, amplitude of the transducers relative to amplitude of the speaker 10, and/or combinations thereof.

Referring now specifically to the insulation layers 52 and 54, it should be understood that any number of layers can be used. Such layers can be made from porous material, such as foam and/or fiberglass blankets used as absorptive material in sound insulation. A micro-perforated panel (herein, "MPP"), on the other hand, uses acoustic resistance of small holes to absorb energy of sound waves. A MPP, in embodiments, is tuned to a given frequency (Hz, cycle/sec) using given parameters of holes and distance from the backing hard wall as will be described with reference to the figures below. For purposes of this disclosure, an MPP is defined as "a device used to absorb sound and reduce sound intensity comprised of, or consisting of, a thin flat plate less than, or equal to, 2 mm thick, with at least one hole or a series of spaced-apart holes."

The acoustic meta material system using micro-perforated panels (MPP) periodically arranged within porous layers and air gaps used in embodiments of the disclosed technology layered device are optimized for acoustic impedance in addition to sound absorption. Traditional micro-perforates are tuned to certain frequencies, as done for Helmholtz resonators, whereas in the present technology, devices are tuned over a wide frequency range of 20-20000 Hz.

The specific acoustic impedance of a micro-perforate is given by:

$$Z=R+j\omega M-jC,$$

Where R is acoustic resistance, M is reactance and C is compliance.

The acoustic resistance term (in the above equation) is given by:

$$R=\left(32\mu\rho\frac{t}{\mathrm{Pa}^2}\right)\left[\sqrt{1+\frac{v^2}{32}}+0.177v\frac{a}{t}\right]$$

where t is MPP panel thickness, a is hole diameter, P is porosity of the panel equal to the ratio of the perforated open area to the total area of the panel and x is kinematic viscosity of air (=10asqrt(f)).

For a conventional MPP, a~t. Thus, above equation can be approximated as:

$$R\approx\left(32\mu\rho\frac{t}{\mathrm{Pa}^2}\right)$$

This means that acoustic resistance is inversely proportional to square of hole diameter, to porosity and proportional to thickness of the MPP panel. Thus, reducing the perforation hole diameter is the most effective way to increase the acoustic resistance of the panel (which also causes the damping of the panel Helmholtz system to increases and the attenuation peak widens). Increasing the thickness of the panel is another way to increase acoustic resistance. However, it is not as effective as reducing the perforation hole diameter. Above equation shows that the panel's acoustical resistance is inversely proportional to the second power of perforation hole diameter while proportional to the first power of panel thickness. That explains why decreasing hole diameter is more effective than increasing panel thickness in increasing the panel acoustic resistance and therefore sound attenuation. The effect of panel thickness is further dimmed due to the so called "effective mass" of the vibrating air. When the air inside an orifice (i.e. a perforated hole) vibrates, the air entering and exiting it also vibrates. This added vibrating air effectively adds mass to the air column inside the orifice and thus makes the equivalent length of the orifice longer than its geometric length. This added effective length at each end of the orifice is approximately 0.85 times the orifice diameter. For the micro-perforated panels, the perforation hole diameter is approximately the same as the panel thickness. Therefore, this added length is 1.7 times the geometric length of the orifice, i.e. the thickness of the panel. As a result, doubling the panel thickness only increases the total effective thickness of the panel by 37%. Hence, although an increase in panel thickness should theoretically increase the panel system resistance, its practical effect is minimal. The positive side of this phenomenon is that reducing the panel thickness does not reduce the panel acoustic resistance much either.

In embodiments of the disclosed technology, non-resonant acoustic meta material layers which utilizes periodic arrangement of meta material MPP sheets and sound absorptive layers as well as air gaps are used. Air gap width, in embodiments of the disclosed technology, is between and including 0.01 mm and 1 mm and can be 0.1 mm. The periodic arrangement of layers of perforated sheets and absorptive layers is designed using acoustic meta material (AMM) principles to optimize and provide optimum acoustic impedance over broadband frequency range. Additionally, this approach may be used to add sound absorption to the layered meta material impedance matching system. For a high powered sub-woofersubwoofer system, acoustic meta material design of the AMM MPP membrane layered system offers high acoustic resistance at low frequency and matches it with the ambient medium so that sound waves are efficiently radiated into the surrounding medium. In the case of a high frequency tweeter acoustic speaker system, the meta material AMM MPP layer matches impedance and radiates sound waves into medium rather than partially reflecting them at the loudspeaker driver. This highly desirable feature of matching high acoustic impedance of the driver to the low impedance of the air renders meta material architectured layered impedance matching system very useful for all loudspeaker systems for efficient sound radiation.

The periodic arrangement of AMM micro-perforated sheets and absorptive layers is required in embodiments for this device and can be optimized to enhance sound radiation over broadband frequency range for a given loudspeaker system, as well as for a given environment, e.g., home audio and other applications. The thickness and material properties of absorptive layers and design parameters of micro-perforated sheets, such as hole diameter, hole spacing etc., is optimized using the meta material approach. In doing so, the hole diameter is, in embodiments of the disclosed technology, between 0.1 and 0.3 mm, the thickness is between 0.1. and 1 mm, and the percent open area is between 0.1 and 5%, inclusive.

The number of micro-perforated sheets, air gaps and absorptive layers is also important in the periodic arrangement of meta material layers and can be optimized to improve impedance matching over broadband frequency range. In practical applications, it may be desired to design an impedance matching product with minimum number of MPP and absorptive layers to achieve optimum result.

In some embodiments of the disclosed technology, there are periodic air gaps introduced between the micro-perforated blocking layers and absorptive layers. For example, air gap may be introduced between each MPP sheet and absorptive layer. The width of the air gap is important for acoustic impedance matching and can be included and optimized in the overall design process.

Each MPP membrane layer can be held at the top and bottom edges to a specially designed ring in embodiments of the disclosed technology. This changes the distance between the MPP membrane and the outside housing (i.e., rigid wall). The absorptive layers may also be supported using the same frame element. The movable membrane system, may be optimized for specific acoustic field with unknown characteristics in a given frequency range by changing distance from the hard wall.

The least mean square (LMS) algorithm is well known in the art of active noise control. An adaptive or active controller is a controller that can change its behavior to maintain good control in response to changes in the process and inputs. In an active noise control application, one attempts to reduce the volume of an unwanted noise propagating through the air using an electro-acoustic system using measurement sensors such as microphones and output actuators such as loudspeakers. Although the objective of a conventional active noise control system is to produce an "anti-noise" that attenuates the unwanted noise in a desired quiet region using an adaptive filter, the application in the current invention is to augment acoustic characteristics of the passive acoustic meta material impedance matching device primarily to enhance its anisotropic behavior.

The least mean square (LMS) algorithm has proved to be a robust algorithm for adaptation of transversal digital filters used for different applications. In active noise control loop, the output of the adaptive filter drives the secondary path, and the error signal is derived only at the error transducer, i.e., microphone. In such cases, a simple LMS algorithm can be unstable due to the phase shift caused by the secondary path. The problem is solved by using a filtered reference or filtered-X LMS algorithm. The main advantage of using filtered-X algorithm is that it is computationally simple like the LMS algorithm and also includes secondary path effects to make it more effective.

Referring now to the Figures, embodiments of the disclosed technology will be explained further.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A speaker comprising:

a diaphragm directing sound transverse to a plane of said diaphragm;

a torus of material surrounding said transverse direction of said sound;

said torus of material further comprising:

at least one layer of a micro-perforated sheet;

at least one layer of insulation;

a plurality of spaced apart transducers on an external side of said torus outputting pressure waves through said at least one micro-perforated sheet.

2. The speaker of claim 1, wherein higher frequency sound is outputted through said diaphragm and lower frequency sound, compared to said higher frequency sound, is directed to said transducers.

3. The speaker of claim 2, wherein said lower frequency sound is pushed transverse to said plane of said diaphragm by said higher frequency sound.

4. The speaker of claim 3, wherein said lower frequency sound and said higher frequency sound join to create waves with higher amplification across an entire frequency spectrum of an output of said speaker.

5. The speaker of claim 1, wherein said at least one layer of said micro-perforated sheet and said at least one layer of insulation have an impedance matching or substantially matching output of said plurality of spaced apart transducers.

6. The speaker of claim 5, wherein said plurality of transducers are fixed to a sheet surrounding said torus.

7. The speaker of claim 6, wherein said plurality of transducers are arranged equi-spaced around said torus.

8. The speaker of claim 7, wherein a second set of transducers are arranged equi-spaced around said torus, at a different distance from said diaphragm than each of said plurality of transducers arranged equi-spaced around said torus.

9. A sound output system, comprising:

a frequency divider which sends higher frequencies to a speaker with diaphragm and comparatively lower frequencies to transducers which generate pressure waves;

alternating micro-perforated sheets and insulation material situated in front of said transducers;

wherein said micro-perforated sheets and insulation in combination have an impedance matched with said pressure waves and an ambient medium generated by said transducers causing amplification thereof.

10. The sound output system of claim 9, wherein said alternating micro-perforated sheets and insulation material are arranged in a torus shape and said transducers are on an exterior side of said torus shape generating said pressure waves towards a center of said torus.

11. The sound output system of claim 10, wherein said alternating micro-perforated sheets and insulation are arranged in a torus with a portal at a center of said torus opening to said diaphragm of said speaker.

12. The sound output system of claim 11, wherein a majority of amplitude of said higher frequencies generated by said diaphragm of said speaker pass through said portal of said torus.

13. The sound output system of claim 12, wherein said pressure waves and waves emanating from said diaphragm of said speaker merge, said waves emanating from said diaphragm causing said pressure waves to move, at least in part, in a direction away from said diaphragm.

14. A speaker arrangement comprising:

a speaker oriented such that sound is directed substantially in a first cardinal direction;

micro-perforated sheets oriented with individual sheets transverse to said first cardinal direction;

a portal surrounded by said micro-perforated sheets open to said speaker such that a majority of said sound passes through said portal when said speaker emits sound;

wherein perforations in each of said individual sheets occur at intervals substantially equal to a thickness of each said individual sheet.

15. The speaker arrangement of claim 14, wherein said portal has a diameter substantially equal to a widest diameter of said speaker.

16. The speaker arrangement of claim 15, wherein said portal is centered over a most elongated length of said speaker.

* * * * *